US007422017B2

(12) United States Patent
Bancroft

(10) Patent No.: US 7,422,017 B2
(45) Date of Patent: Sep. 9, 2008

(54) MOUTHGUARD

(75) Inventor: James Bancroft, Englewood Cliffs, NJ (US)

(73) Assignee: Total Gard Corporation, Teaneck, NJ (US)

( * ) Notice: Subject to any disclaimer, the term of this patent is extended or adjusted under 35 U.S.C. 154(b) by 0 days.

(21) Appl. No.: 11/430,024

(22) Filed: May 9, 2006

(65) Prior Publication Data

US 2007/0131232 A1 Jun. 14, 2007

Related U.S. Application Data

(63) Continuation of application No. 10/014,440, filed on Dec. 14, 2001, now Pat. No. 7,128,072.

(51) Int. Cl.
*A61C 5/14* (2006.01)

(52) U.S. Cl. ..... 128/859; 128/861

(58) Field of Classification Search ..... 128/846, 128/848, 849–862; 2/2; 602/902
See application file for complete search history.

(56) References Cited

U.S. PATENT DOCUMENTS

| | | | |
|---|---|---|---|
| 347,976 | A | 8/1886 | Starr |
| 1,302,004 | A | 4/1919 | Brown |
| 1,489,192 | A | 4/1924 | Cleveland |
| 1,652,910 | A | 12/1927 | Psayla |
| 1,674,336 | A | 6/1928 | King |
| 1,775,718 | A | 9/1930 | Garvey |
| 2,142,614 | A | 1/1939 | Mitchell |

(Continued)

FOREIGN PATENT DOCUMENTS

| | | |
|---|---|---|
| DE | 2320501 | 4/1973 |

(Continued)

OTHER PUBLICATIONS

Ontario Minor Hockey Association 2001 Guidelines on the Wearing of Mouthguards.

(Continued)

*Primary Examiner*—Michael A. Brown
(74) *Attorney, Agent, or Firm*—Townsend and Townsend and Crew LLP

(57) ABSTRACT

A mouthguard has a flexible frame, and has bite tabs extending from the rear surface of the frame for engaging the wearer's teeth. The bite tabs extending from the rear surface of the frame for engaging the wearer's teeth. A narrow split may be provided between the anterior bite tabs that allows the bite tabs to maintain their flexibility. The flexible frame lays against the outer surface of the teeth and extends into the buccal folds superiorly and interiorly of the cheek where the muscles hold it in place. Grooves may be positioned lengthwise along the frame above and below the bite tabs for purposes of flexibility and to allow the muscles of the cheek to press the upper and lower extensions of the frame close to the bone for better retention and comfort. The teeth engage the bite tabs, thus preventing the teeth from clashing together and protecting the temporomanibular joint (TMJ). One or more air holes may be provided in the front portion of the mouthguard permitting easy breathing. The mouthguard is retained by the muscles of the lips and cheeks, causes no gag reflex, and is simple, comfortable and protective.

45 Claims, 2 Drawing Sheets

U.S. PATENT DOCUMENTS

| | | | |
|---|---|---|---|
| 2,424,533 | A | 7/1947 | Faires |
| 2,483,157 | A | 9/1949 | Singer |
| 2,521,039 | A | 9/1950 | Carpenter |
| 2,521,084 | A | 9/1950 | Oberto |
| 2,574,623 | A | 11/1951 | Clyde |
| 2,590,118 | A | 3/1952 | Oddo |
| 2,600,025 | A | 6/1952 | Sage |
| 2,627,268 | A | 3/1953 | Leppich |
| 2,669,988 | A | 2/1954 | Carpenter |
| 2,857,909 | A | 10/1958 | Johnson |
| 3,082,765 | A | 3/1963 | Helmer |
| 3,187,746 | A | 6/1965 | Gerber |
| 3,203,417 | A | 8/1965 | Helmer |
| 3,236,235 | A | 2/1966 | Jacobs |
| 3,307,539 | A | 3/1967 | Petersen |
| 3,312,218 | A | 4/1967 | Jacobs |
| 3,333,582 | A | 8/1967 | Cathcart |
| 3,457,916 | A | 7/1969 | Wolicki |
| 3,525,520 | A | 8/1970 | Dwyer |
| 4,031,888 | A | 6/1977 | Walters |
| 4,114,614 | A | 9/1978 | Kesling |
| 4,185,817 | A | 1/1980 | Peterson |
| 4,350,154 | A | 9/1982 | Feldbau |
| 4,718,662 | A | 1/1988 | North |
| 4,765,324 | A | 8/1988 | Lake, Jr. |
| D300,059 | S | 2/1989 | Pier |
| 4,862,903 | A | 9/1989 | Campbell |
| 5,062,422 | A | 11/1991 | Kinkade |
| 5,165,423 | A | 11/1992 | Fowler et al. |
| 5,203,324 | A | 4/1993 | Kinkade |
| 5,234,005 | A | 8/1993 | Kittelsen et al. |
| 5,259,762 | A | 11/1993 | Farrell |
| 5,277,202 | A | 1/1994 | Hays |
| 5,277,203 | A | 1/1994 | Hays |
| 5,447,168 | A * | 9/1995 | Bancroft ..... 128/859 |
| 5,462,066 | A | 10/1995 | Snyder |
| 5,582,560 | A | 12/1996 | Magnuson |
| 5,592,951 | A | 1/1997 | Castagnaro et al. |
| 5,601,093 | A | 2/1997 | Sheehan |
| 5,620,011 | A | 4/1997 | Flowers |
| 5,624,257 | A | 4/1997 | Farrell |
| 5,636,379 | A | 6/1997 | Williams |
| 5,642,738 | A | 7/1997 | Lilly, Jr. |
| 5,682,904 | A | 11/1997 | Stinnett |
| 5,692,523 | A | 12/1997 | Croll et al. |
| 5,732,715 | A | 3/1998 | Jacobs et al. |
| 5,829,441 | A | 11/1998 | Kidd et al. |
| D406,647 | S | 3/1999 | Wagner |
| 5,921,240 | A | 7/1999 | Gall |
| 6,053,168 | A | 4/2000 | Sue |
| 6,269,816 | B1 | 8/2001 | Rigonatti et al. |
| 6,681,771 | B2 | 1/2004 | Durette |

FOREIGN PATENT DOCUMENTS

| | | | |
|---|---|---|---|
| DE | 3915505 | A1 | 5/1989 |
| WO | WO0035369 | * | 6/2000 |

OTHER PUBLICATIONS

Total Gard Orthodontic Sports Mouthguard Brochure.
Physical Sample of a Total Gard Mouthguard (yellow_mouthguard).
Physical Sample of a Total Gard Mouthguard (this mouthguard has a shorter breathing aperture than the yellow mouthguard).
Ontario Minor Hockey Association Jun. 2001 Guidelines on the Wearing of Mouthguards.
Total Guard Orthodontic Sports Mouthguard Brochure.

* cited by examiner

MOUTHGUARD

CROSS-REFERENCE TO RELATED APPLICATIONS

This application is a continuation of U.S. application Ser. No. 10/014,440 filed on Dec. 14, 2001 now U.S Pat. No. 7,128,072, the disclosure of which is incorporated herein by reference in its entirety.

BACKGROUND OF THE INVENTION

1. Field of the Invention

This invention relates generally to mouthguards and, more particularly to a mouthguard which is retained in position by the muscles of the lips and cheeks and produces no gag reflex. It is designed to fit comfortably over orthodontic appliances or to fit over the teeth naturally without orthodontic appliances of both maxillary and mandibular arches.

2. Related Art

U.S. Pat. No. 2,590,118 to Oddo discloses a mouthpiece having upper and lower channels for the teeth and pivotal front portions of the guard to permit opening of the mouth.

U.S. Pat. No. 4,114,614 to Kesling, discloses a mouthguard appliance comprising a pair of allochiral arch shaped members hingedly connected together and made of a resilient material. The hinge permits folding of the arch shaped members together to retain the members in place on the arches. The teeth contact a plurality of ridges to hold the mouthguard in position.

Various other mouthguards have been proposed; some by the inventor of this patent. For instance, in U.S. Pat. No. 5,447,168, which is incorporated by reference herein, the inventor discloses a mouthguard which is simple, comfortable, does not join across the rear of the mouth, and may include an anterior aperture to facilitate breathing. The mouthguard is retained in position by the muscles of the lips and cheeks and protects the teeth of the wearer without inducing gagging—a problem with many other mouthguards. It also protects lips from impacting on the teeth or orthodontic appliances in the event of facial trauma. It further protects the temporomandibular joint (TMJ).

While mouthguards of the type disclosed in the inventor's prior patent have been commercialized and work well in practice, they were particularly designed for orthodontic applications where the braces themselves help support and protect the teeth by providing a splinting action. For non-orthodontic applications in which the wearer does not have braces, there is a, need for a mouthguard having the benefits and advantage of the general type disclosed in U.S. Pat. No. 5,447,168, but which is of a stronger design providing even more protection for the wearer's teeth.

SUMMARY OF THE INVENTION

This invention meets the above need, while avoiding the disadvantages and drawbacks of the prior art by providing a mouthguard that is simple, comfortable, and protects the teeth including some or all of the anterior teeth without inducing gagging. The invention includes a bite tab that provides added protection to the front teeth—it provides increased protection from trauma and helps prevent the teeth from grinding together. A stress-breaking split may be inserted in the anterior portion of the bite tab to help maintain its flexibility. The split may enhance the mouthguard's ability to adapt to any arch width size so that no adjustments such as boiling or trimming are required. Thus, no time consuming preparations are needed prior to using the mouthguard—it is ready to wear.

The mouthguard of the invention thus provides protection to the teeth, lips, gums, and TMJ while helping to eliminate the gagging caused by other mouthguards. It provides these safety features, and at the same time is convenient, simple to use, and inexpensive.

In particular, the invention accomplishes one or more of these benefits or advantages by providing a mouthguard for insertion into a wearer's mouth to protect the wearer's teeth and temporomandibular joint from trauma. The mouthguard may be a generally curved, flexible member that includes a central portion for protecting the wearer's anterior teeth and two end members each extending rearwardly from the central portion for protecting the wearer's posterior teeth. The flexible member may have a front surface adjacent the wearer's lips and cheeks, a rear surface adjacent the wearer's anterior and posterior teeth when the mouthguard is inserted into the wearer's mouth, and a thickness defined by the distance between the front and rear surfaces. A first groove may extend into one of said front and rear surfaces a predetermined depth less than the thickness of said flexible member, the groove defining a first hinge permitting flexing of a portion of the flexible member about the hinge to conform to the wearer's mouth. A bite tab may be utilized that projects inwardly from the central portion and the end members, and is adapted to be engaged by at least one of the wearer's anterior teeth and one of the wearer's posterior teeth.

According to another aspect of the invention, a mouthguard may have a frame member adapted to fit into the mouth of a wearer, wherein the frame member has an outwardly facing front surface, an inwardly facing rear surface, a central portion and end portions extending from the central portion. A bite tab having top and bottom surfaces may be provided that is adapted to engage at least a portion of both the top and bottom teeth of the wearer. The bite tab may extend inwardly from the central portion of the frame and be positioned so to engage at least a portion of the front teeth of the wearer when the jaw of the wearer's mouth is closed. A division may extend to at least one of top and bottom surfaces and separate the bite tab into two sections to provide flexibility. The division permits spacing between the bite tab sections to change to accommodate different mouth sizes, and may be an opening that forms a partial split or a complete split, such as a narrow opening, between bite tab sections. Multiple divisions may be provided in the anterior and/or posterior portions of the bite tab sections.

According to yet another aspect of the invention, a mouthguard may have a flexible means for protecting a wearer's lips and teeth from trauma. The flexible means may be adapted to be disposed between the inside of the lips and outside of the teeth of a wearer. The mouthguard may also include a means for engaging at least some occlusal surfaces of both the anterior and posterior teeth of a wearer of the mouthguard. The means for engaging the teeth may include means for adding flexibility to the anterior and posterior teeth engaging means.

According to yet another aspect of the invention, a mouthguard may have a frame member having an inwardly facing rear surface disposable adjacent a wearer's teeth, and an outwardly facing front surface disposable adjacent to the wearer's lips and cheeks. One of said front and rear surfaces may include a transition separating the one surface into first and second portions that are offset from each other such that the first portion extends outwardly further than second portion. The first portion may be an upper portion of the frame member, the second portion may be a lower portion of the frame member, and the transition may be in the form of a shoulder separating the upper and lower portions from each other. A first bite tab portion maybe adapted to engage at least a portion of a front tooth of the wearer when the jaw of wearer is closed. The first bite tab portion may have a proximal side adjacent the rear surface of the frame member, and a distal side opposite the proximal side. A second bite tab portion may be adapted to engage at least a portion of a back tooth of the wearer when the jaw of wearer is closed. The second bite tab portion may have a proximal side adjacent the rear surface of said frame member, and a distal side opposite the proximal side. The mouthguard protects the teeth of the wearer without inducing gagging and need not be boiled or trimmed prior to being used by the wearer.

According to yet another aspect of the invention, a mouthguard may have a frame member adapted to fit into the mouth of a wearer. The frame member has an outwardly facing front surface, an inwardly facing rear surface, a central portion and end portions extending from the central portion. A bite tab may have top and bottom surfaces adapted to engage at least a portion of both the top and bottom teeth of the wearer. The bite tab may extend inwardly from the central portion of said frame and be positioned to engage at least a portion of the front teeth of the wearer when the jaw of the wearer's mouth is closed. A division may separate the bite tab into sections of differing thickness extending along the frame member to engage different teeth and to form a flexible hinge for permitting spacing between said bite tab sections to change to accommodate different mouth sizes.

DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
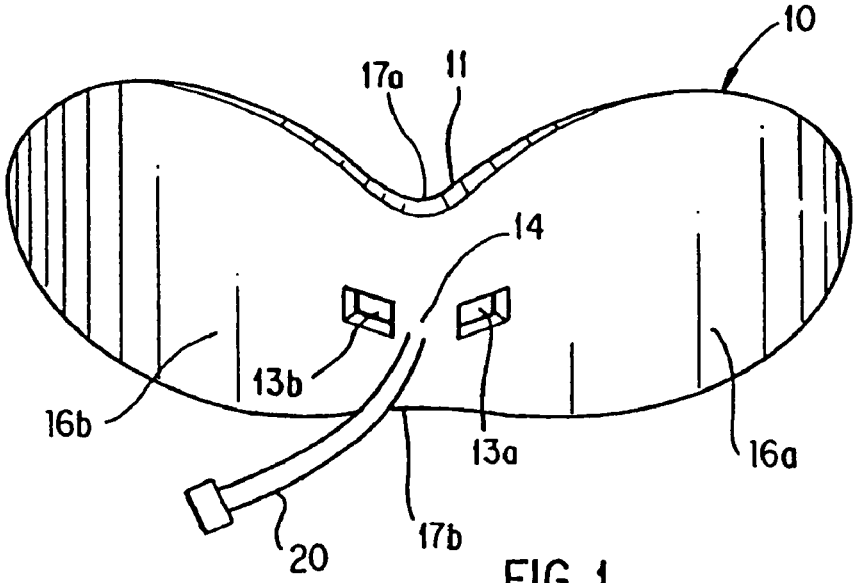
FIG. 1 is a front perspective view of a first embodiment of a mouthguard constructed according to the principles of the invention.
Figure 2:
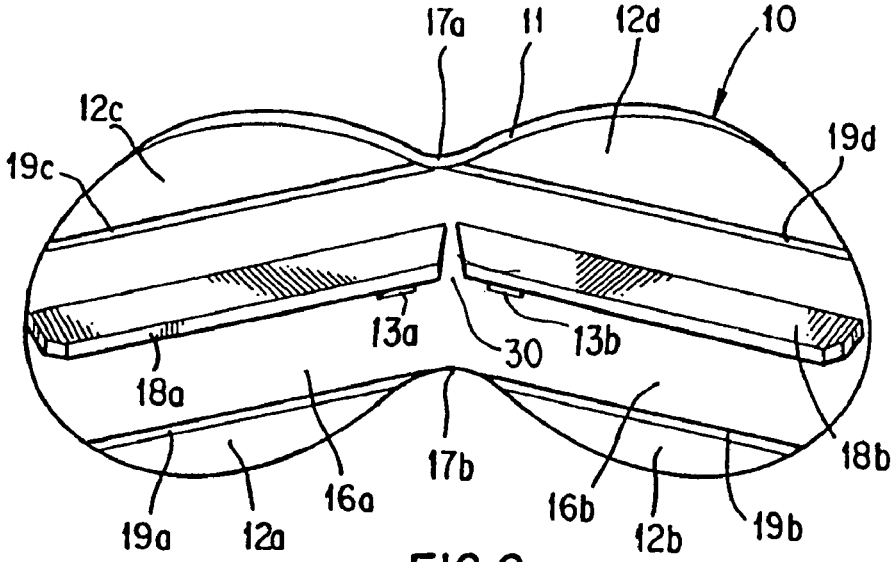
FIG. 2 is a rear view of the first embodiment of the invention with a curved frame element stretched out into a vertical plane.
Figure 3:
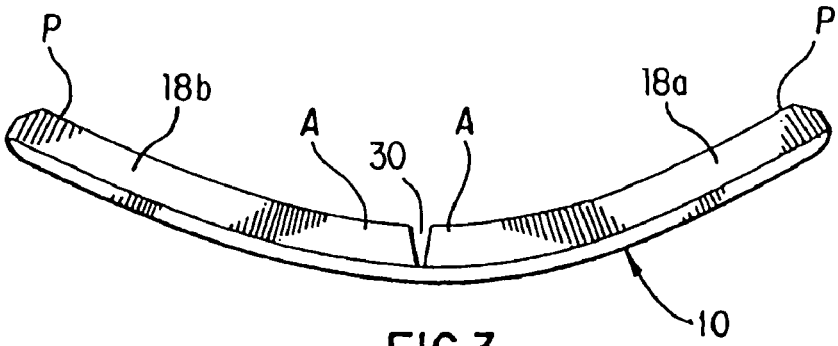
FIG. 3 is a top view of the first embodiment of the invention.
Figure 4:
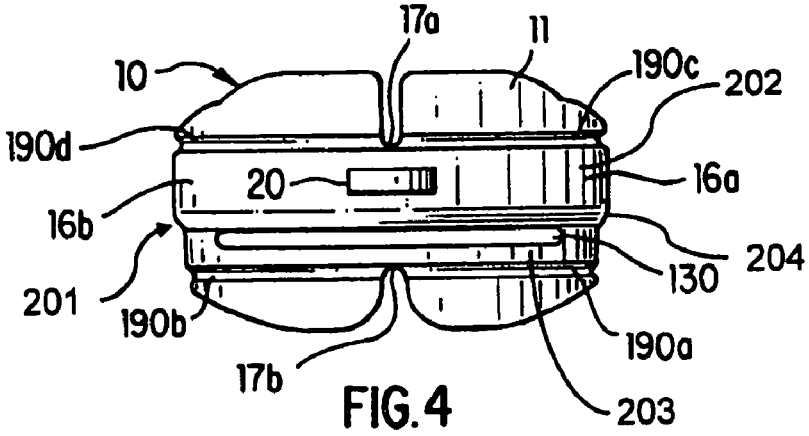
FIG. 4 is a front view of a second embodiment of the invention.
Figure 5:
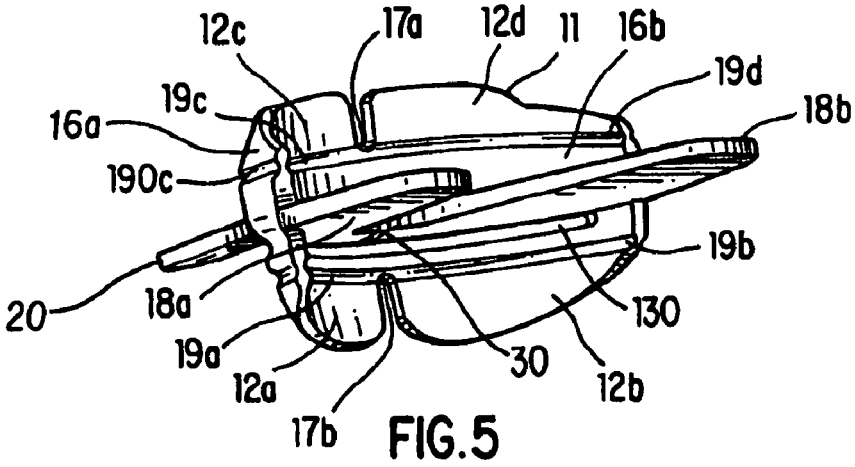
FIG. 5 is a rear perspective view of the second embodiment of the invention.
Figure 6:
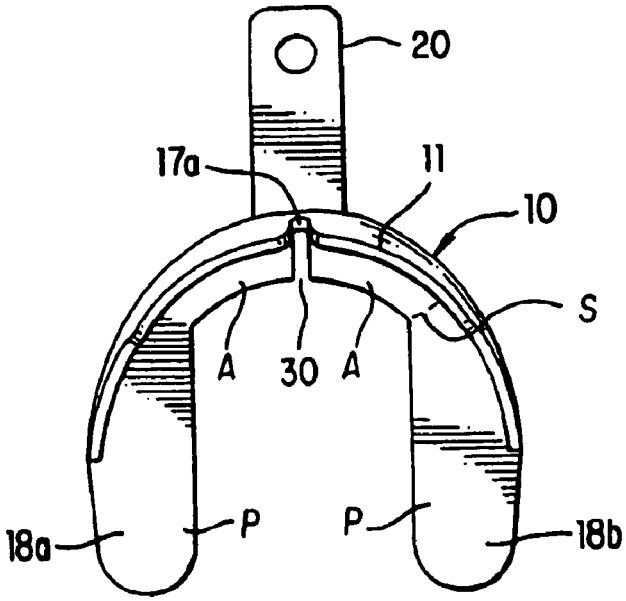
FIG. 6 is a top view of the second embodiment of the invention.

Two different mouthguard designs are illustrated in FIGS. 1-6. FIGS. 1-3 illustrate a first embodiment of the invention. FIGS. 4-6 illustrate a second embodiment of the invention. These two mouthguards are merely examples of how one of ordinary skill in the art could implement the invention, and are not the only examples falling within the scope of the invention. Where applicable, the same reference numerals are used to illustrate the features of both embodiments (i.e., FIGS. 1-3 and FIGS. 4-6).

Referring now to the drawings, the mouthguard 10 has a curved frame member 11 which fits against the inside of the lips, cheeks and outside of teeth. The curvature is designed to accommodate the contour of the user's mouth. In the first embodiment shown in FIG. 1, the mouthpiece includes two or more apertures 13*a* and 13*b* which facilitate breathing with the mouthpiece in place. A pair of rectangular apertures are shown with a portion 14 of the frame 11 separating the apertures. In the alternative, a single aperture or a plurality of apertures could be used to provide an opening for breathing. A single aperture 130 is illustrated in the second embodiment, shown in FIGS. 4 and 5. The frame member 11 includes two enlarged curved end members 16*a* and 16*b* which join at central recessed slots 17*a* and 17*b*. The slots 17*a* and 17*b* are designed to provide additional comfort for the user of the mouthguard 10.

In the first embodiment (shown in FIGS. 1-3), the rear portion of the mouthguard includes projecting elements 18*a* and 18*b* which may extend inwardly at a suitable angle, such as a right angle, from the rear surface of frame 11. Elements 18*a* and 18*b* may be positioned above or below the apertures. The inwardly projecting elements 18*a* and 18*b* are located above the apertures 13*a* and 13*b* of the first embodiment, and are located just above aperture 130 of the second embodiment (FIGS. 4-6). The inwardly projecting elements 18*a* and 18*b* include posterior portions and anterior portions shown generally at reference letters P and A of FIGS. 3 and 6, respectively. The posterior and anterior portions of each inwardly projecting element are illustrated as having the same thickness (for instance, approximately 4.25 mm. thick). However, the thickness of each portion can vary. The anterior portion of each inwardly projecting element could be thinner than the corresponding posterior portion, or vice-versa. For example, the anterior portion could be approximately 2 mm. thick and the corresponding posterior portion could be approximately 4.25 mm. thick. The posterior portions of elements 18*a* and 18*b* are adapted to engage some or all of the posterior teeth of a person wearing the mouthguard. The anterior portions of elements 18*a* and 18*b* are adapted to engage at least a portion of one of a user's two front teeth (either one of the top two or bottom two front teeth). The inwardly projecting elements 18*a* and 18*b* shown in FIGS. 1-6 together are designed to engage at least a portion of all of the teeth of a person wearing the mouthguard 10. However, these inwardly projecting elements could engage less than all of the teeth.

A split 30 may be provided to separate the anterior portions of elements 18*a* and 18*b*. The split 30 is illustrated in FIGS. 2-3 and 5-6 as a slit (i.e., a long, narrow opening) located between the recessed slots 17*a* and 17*b* of the frame member 11, but, of course, could take other forms recognized by those skilled in the art, some of which are described below. Moreover, the split 30 could be eliminated and the anterior portions could be connected—either integrally or otherwise—but in most designs it is preferable to have a split 30 of about 1 millimeter in width. The split 30 provides a number of benefits. For instance, split 30 acts as a stress breaking component that adds flexibility to the inwardly projecting elements. The added flexibility may help eliminate the need to heat set or trim the mouthguard prior to use to conform to an individual wearer's teeth (as in some conventional mouthguards).

Various modifications to the split 30 and inwardly projecting elements 18*a* and 18*b* are possible. For instance, depending upon the desired performance characteristics of the mouthguard, the split 30 could be widened, narrowed, or even moved. Although the split 30 is illustrated as a complete split, (i.e., the ends of the anterior portions of the inwardly projecting elements 18*a* and 18*b* are not directly connected), the split could be only a partial or a substantial split, such as a reduced thickness portion forming a flexible hinge. Moreover, additional splits can be used. One, two, three, four or more splits of various sizes can be inserted in any of the anterior or posterior portions of the inwardly projecting elements 18*a* and 18*b*. The dotted line shown in FIG. 6, labeled with the letter S, illustrates but one example of a location where an additional split could be inserted. Furthermore, the posterior and anterior portions of each inwardly projecting element 18*a* and 18*b* are illustrated as being integrally formed with one another. However, the posterior and anterior portions could be separate pieces having a split between them; or they could be separately formed pieces that are connected together.

The mouthguard 10 lays against the outer surface of the teeth which grasp both sides of the inwardly projecting elements 18*a* and 18*b*. This provides protection to the temporomandibular joint (TMJ), the anterior teeth, and the posterior teeth against straight-on blows. The curved end members 16*a* and 16*b* may have horizontally running flexible grooves (joints), functioning as hinges 19*a-d* which allow the muscles in the cheek to press the extensions 12*a*, 12*b*, 12*c*, 12*d* close to the bone for better retention and comfort. In the first embodiment shown in FIGS. 1-3, flexible grooves 19*a-d* are provided on the rear surface of end sections 16*a* and 16*b*. As shown in FIG. 4, flexible grooves 190*a-d* can also be placed along the front surface of the curved end sections 16*a* and 16*b* to provide the extensions 12*a*, 12*b*, 12*c*, and 12*d* with added flexibility. Of course, the flexible grooves could be provided solely on the front surface of the mouthguard. With the teeth engaged from both sides of the inwardly projecting elements, the teeth are prevented from clashing together and the wearer is protected from TMJ. The mouthguard is retained by the muscles of the lips and cheek and causes no gag reflex and is simple, comfortable and protective.

The lengthwise horizontal grooves 19*a*, 19*b*, 19*c*, 19*d* (and the grooves 190*a-d* in the second embodiment) on each side of the posterior extensions provide flexibility particularly during insertion of the mouthguard 10. The flexible mouthguard is also normally in a curved position to permit ease of installation in the user's mouth. If desired, a helmet strap attachment 20 can be molded to the central portion 14 of the outer frame element, as shown schematically in FIG. 1 and in FIG. 4.

As shown in FIGS. 4-5, the second embodiment contains a third horizontal groove 201 located on the front curved surface of the mouthguard. The groove 201 is defined by a shoulder 204 located just above aperture 130, and below helmet strap attachment 20. In this example, the shoulder 204 is located at about the level of the inwardly projecting elements 18*a* and 18*b*. Because of the shoulder 204, the front curved surface 202 of the mouthguard located immediately above the inwardly projecting elements has a greater circumference than the front curved surface of the mouthguard located below the inwardly projecting elements. In other words, the mouthguard's top front curved surface 202 generally extends farther outside than does its bottom front curved surface 203.

In an alternative design to these mouthguards shown in FIGS. 1-6, the frame 11 as shown in the figures could be altered so that the alternative frame is merely a portion of frame 11. This alternative frame would be the equivalent of either the portions of frame 11 (shown in FIGS. 2 and 4) that are just above or below the inwardly projecting elements 18*a* and 18*b*. The resulting mouthguard can thus conceptually be viewed as either of the mouthguards shown in FIGS. 1-6 having been cut just above or below the inwardly projecting elements 18*a* and 18*b*.

The mouthguard protects the lips against impact trauma. The mouthguard 10 also protects the teeth from trauma and clashing together or grinding and protects the TMJ from traumas due to a blow to the mandible.

While the invention has been explained by a detailed description of certain specific embodiments, it is understood that various modifications and substitutions can be made in any of them within the scope of the appended claims, which are intended also to include equivalents of such embodiments.

What is claimed is:

1. A mouthguard comprising:

a frame member adapted to fit into the mouth of a wearer, wherein said frame member has an outwardly facing front surface, an inwardly facing rear surface, a central portion and end portions extending from said central portion;

a bite tab having top and bottom surfaces adapted to engage at least a portion of both the top and bottom teeth of the wearer, said bite tab extending inwardly from the central portion of said frame and positioned to engage at least a portion of the front teeth of the wearer when the jaw of the wearer's mouth is closed; and a division extending to at least one of said top and bottom surfaces, said division separating said bite tab into sections to provide flexibility and permitting spacing between said bite tab sections to change to accommodate different mouth sizes.

2. The mouthguard of claim 1, wherein said division comprises at least one of a narrow opening, a partial split, and a complete split.

3. The mouthguard of claim 1, further comprising a plurality of divisions in said bite tab dividing said bite tab into at least three sections.

4. The mouthguard of claim 3, wherein said plurality of divisions comprise at least one of a narrow opening, partial split, and complete split.

5. The mouthguard of claim 1, wherein said sections of said bite tab include a posterior portion adapted to engage at least one of the posterior teeth of a wearer.

6. The mouthguard of claim 5, wherein said bite tab is adapted to engage all of the top and bottom teeth of the wearer.

7. The mouthguard of claim 1, wherein said division is located in a posterior section of said bite tab.

8. The mouthguard of claim 1, wherein said division is located in an anterior section of said bite tab.

9. The mouthguard of claim 1, wherein the front surface of said frame member is designed to lie adjacent to the wearer's lips and cheeks, and the rear surface of said frame member is designed to lie adjacent to at least some of the wearer's teeth so as to allow the muscles of the lips and cheeks of the wearer to retain the mouthguard.

10. The mouthguard of claim 1, further comprising a groove extending along at least one of the front and rear surfaces of said frame member, said groove facilitating flexing of a portion of said frame member.

11. The mouthguard of claim 1, further comprising an air hole in said frame member.

12. The mouthguard of claim 1, further comprising a helmet strap attachment coupled to said frame member.

13. The mouthguard of claim 1, wherein said bite tab sections extend rearwardly past the end portions of said frame member.

14. The mouthguard of claim 1, wherein said frame member is adapted to be adjacent to some of the wearer's anterior and some of the wearer's posterior teeth when in use.

15. A mouthguard comprising:

a frame member adapted to fit into the mouth of a wearer, wherein said frame member has an outwardly facing front surface, an inwardly facing rear surface, a central portion and end portions extending from said central portion;

a bite tab having top and bottom surfaces adapted to engage at least a portion of both the top and bottom teeth of the wearer, said bite tab extending inwardly from the central portion of said frame and positioned to engage at least a portion of the front teeth of the wearer when the jaw of the wearer's mouth is closed; and a division separating said bite tab into sections of differing thickness extending along the frame member to engage different teeth and to form a flexible hinge for permitting spacing between said bite tab sections to change to accommodate different mouth sizes.

16. The mouthguard of claim 15, wherein said division completely disconnects said bite tab sections from each other.

17. The mouthguard of claim 15, wherein said division comprises a reduced thickness portion relative to the thickness of said bite tabs.

18. The mouthguard of claim 15, wherein said division comprises at least one of a narrow opening, a partial split, and a complete split.

19. The mouthguard of claim 15, wherein said division comprises a plurality of divisions dividing said bite tab into at least three sections.

20. The mouthguard of claim 19, wherein said plurality of divisions comprise at least one of a narrow opening, partial split, and complete split.

21. The mouthguard of claim 15, wherein said sections of said bite tab include a posterior portion adapted to engage at least one of the posterior teeth of a wearer.

22. The mouthguard of claim 21, wherein said bite tab is adapted to engage substantially all of the top and bottom teeth of the wearer.

23. The mouthguard of claim 15, wherein said division is located in one of a posterior section and an anterior section of said bite tab.

24. The mouthguard of claim 15, wherein the front surface of said frame member is designed to lie adjacent to the wearer's lips and cheeks, and the rear surface of said frame member is designed to lie adjacent to at least some of the wearer's teeth so as to allow the muscles of the lips and cheeks of the wearer to retain the mouthguard.

25. The mouthguard of claim 15, further comprising a groove extending along at least one of the front and rear surfaces of said frame member, said groove facilitating flexing of a portion of said frame member.

26. The mouthguard of claim 1, wherein said frame member is adapted to fit over one of the maxillary and mandibular arches of the wearer.

27. The mouthguard of claim 1, wherein said frame member is adapted to fit over both of the maxillary and mandibular arches of the wearer.

28. The mouthguard of claim 26, wherein said mouthguard protects the teeth against at least one of grinding, clashing together, and traumas due to impact.

29. The mouthguard of claim 27, wherein said mouthguard protects the teeth against at least one of grinding, clashing together, and traumas due to impact.

30. The mouthguard of claim 1, wherein said division eliminates the need to heat set and/or trim the mouthguard prior to use.

31. The mouthguard of claim 26, further comprising a groove extending along said frame member to facilitate flexing of a portion of said frame member.

32. The mouthguard of claim 27, further comprising a pair of spaced grooves, each extending along said frame member to facilitate flexing of portions of said frame member.

33. The mouthguard of claim 32, wherein said bite tab sections are located between said pair of grooves.

34. The mouthguard of claim 33, wherein a first one of said spaced grooves permits flexing of a first outward section of said frame member disposed above said first groove, and the second one of said spaced grooves permits flexing of a second outward section of said frame member disposed below said second groove.

35. The mouthguard of claim 15, wherein said frame member is adapted to fit over one of the maxillary and mandibular arches of the wearer.

36. The mouthguard of claim 15, wherein said frame member is adapted to fit over both of the maxillary and mandibular arches of the wearer.

37. The mouthguard of claim 35, wherein said mouthguard protects the teeth against at least one of grinding, clashing together, and traumas due to impact.

38. The mouthguard of claim 36, wherein said mouthguard protects the teeth against at least one of grinding, clashing together, and traumas due to impact.

39. The mouthguard of claim 15, wherein said division eliminates the need to heat set and/or trim the mouthguard prior to use.

40. The mouthguard of claim 35, further comprising a groove extending along said frame member to facilitate flexing of a portion of said frame member.

41. The mouthguard of claim 36, further comprising a pair of spaced grooves, each extending along said frame member to facilitate flexing of portions of said frame member.

42. The mouthguard of claim 41, wherein said bite tab sections are located between said pair of grooves.

43. The mouthguard of claim 42, wherein a first one of said spaced grooves permits flexing of a first outward section of said frame member disposed above said first groove, and the second one of said spaced grooves permits flexing of a second outward section of said frame member disposed below said second groove.

44. The mouthguard of claim 5, wherein each posterior portion of said sections of said bite tab extends inwardly from one of the end portions of said frame member.

45. The mouthguard of claim 21, wherein each posterior portion of said sections of said bite tab extends inwardly from one of the end portions of said frame member.

* * * * *